US005683305A

United States Patent [19]

Andersson

[11] Patent Number: 5,683,305

[45] Date of Patent: Nov. 4, 1997

[54] BALL-GUIDING TEEING UP DEVICE

[76] Inventor: Per-Olov Andersson, Hyttevagen 2, Iggesund, S-825 32, Sweden

[21] Appl. No.: 646,312

[22] PCT Filed: Apr. 19, 1994

[86] PCT No.: PCT/SE94/00345

§ 371 Date: May 13, 1996

§ 102(e) Date: May 13, 1996

[87] PCT Pub. No.: WO94/25122

PCT Pub. Date: Nov. 10, 1994

[30] Foreign Application Priority Data

Apr. 27, 1993 [SE] Sweden ..... 9301404

[51] Int. Cl.[6] ..... A63B 57/00

[52] U.S. Cl. ..... 473/132; 473/387

[58] Field of Search ..... 473/387–403, 473/278, 132, 137

[56] References Cited

U.S. PATENT DOCUMENTS

| | | | |
|---|---|---|---|
| 1,570,926 | 1/1926 | Sibbald | 473/398 |
| 1,595,130 | 8/1926 | Wilcox | 473/392 |
| 1,671,813 | 5/1928 | Clarke | 473/403 |
| 1,755,344 | 4/1930 | Acaster | 473/394 |
| 3,127,177 | 3/1964 | Benkoe | 473/137 |
| 3,424,457 | 1/1969 | Robertson | 473/388 |
| 4,260,157 | 4/1981 | Jones et al. | 473/278 |
| 5,383,668 | 1/1995 | Andrikian | 473/132 |

FOREIGN PATENT DOCUMENTS

| | | | |
|---|---|---|---|
| 305820 | 2/1929 | United Kingdom | 273/33 |

*Primary Examiner*—Steven B. Wong
*Attorney, Agent, or Firm*—Browdy and Neimark

[57] ABSTRACT

A device for teeing up a golf ball is formed of a continuous single rod bent into a V-shaped portion having two straight legs to form an inclined ramp, and a slightly cup-shaped circular portion at the upper end of the V-shape which acts as a ball-cup to hold the golf ball for teeing. The ball is rolled up the ramp by pushing it with a club and at the top falls into the ball-cup. This avoids any bending by the player. The ramp is wider at the bottom than the top and the rod is springy to deflect when hit by the club. Each ramp leg is bent at the lower end distal the ball-cup to extend horizontally for attachment to a ground plate that supports the rod device. The ball-cup is generally circular as seen from above but is bowed slightly as seen from the side to prevent the ball from rolling over the lip distal the ramp.

11 Claims, 1 Drawing Sheet

BALL-GUIDING TEEING UP DEVICE

FIELD OF INVENTION

The present invention refers to a device which will eliminate a troublesome moment when practising on the driving range, namely the necessity of, between every practise-shot, having to bend down and tee up the ball.

RELATED TECHNOLOGY

When training with certain wood and ironclubs from a tee-mat, it is customary to place the ball on a peg of wood or plastic in order to facilitate the hitting of the ball. Before every shot you consequently bend down and insert a peg in the mat on which the ball i placed. As you often hit a large number of balls, the bending down and teeing up becomes very annoying and tiresome.

SUMMARY OF THE INVENTION

It is possible to be spared from bending down and instead, standing upright, be able to poke up the ball on the peg with the club-head. Up to now this method has not been known, but with the device here described it is quite possible. Another advantage with this device is that you do not have to pick up pegs which are scattered around the tee-mat.

The purpose with the invention is to produce a device, which makes it possible for the golfer, without bending down, to move the ball from the mat up on the device to the height of a normal peg and when the ball has reached that position, hit it from the device in exactly the same manner as from a normal peg. This task has been solved by forming the device as an inclined plane from the mat to the level of a normal peg height. Sometimes the ball is hit low and then the club-head hits the inclined plane. Therefore the device is constructed in such a manner that the inclined plane is elastic and is bent out of the way when hit by the club-head.

The present invention has a unitary long rod (for example, a wire) bent or molded into a shape as clearly seen in FIG. 1. The shape has a truncated V-shaped portion having a wider base and a narrower upper end. The truncated V-shaped portion acts as an upwardly inclined ramp as seen in FIG. 2. At the upper end the elongate rod is formed into a generally circular portion as seen at the left-hand side of FIG. 1, here referred to as a slightly cup-shaped circular portion, which has a ball-cup for holding the golf ball. That is, the rod includes a first leg of the inclined ramp and a second leg of the inclined ramp, both continuous with a respective first and second end of the circular portion. The inclined ramp is elastic because the rod is made of a springy material, like a plastic or iron-containing metal. The slightly cup-shaped circular portion is generally circular in a first plane defined by the inclined ramp (i.e. generally in the plane of the paper in FIG. 1) and is slightly cup-shaped in a second plane perpendicular to the first plane and parallel to a length of the inclined ramp (i.e. generally the plane of the paper in FIG. 2).

DESCRIPTION OF THE PREFERRED EMBODIMENT

Figure 1:
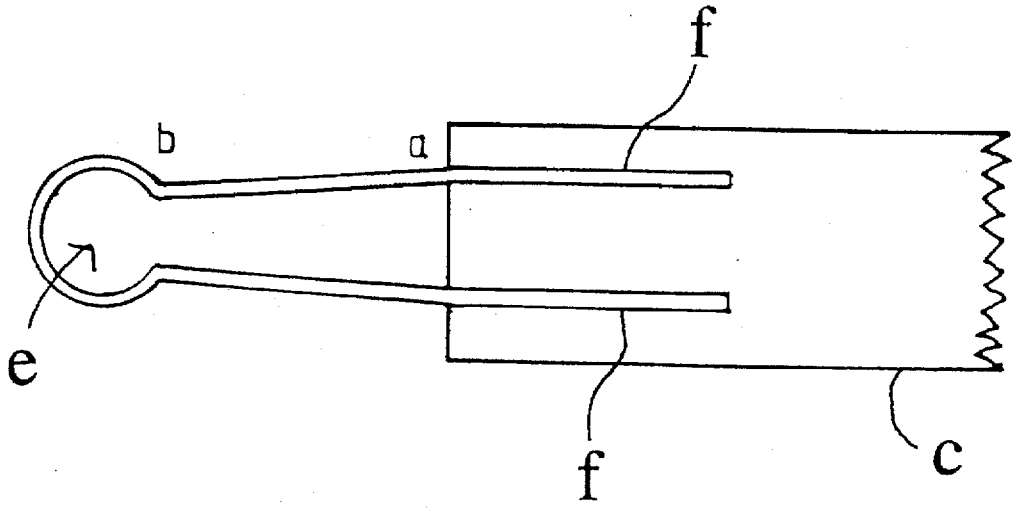
FIG. 1 shows the device seen from above.

The present invention is made of an elastic material. The material is shaped as shown i FIG. 1. At the level of (a) the material is formed in such a manner that it is given a narrowing V-shape up to (b) where it takes a circular form, which is the ball-lie (e). The V-shape is intended to facilitate the poking up of the ball with the club-head from the mat to the ball-lie of the device. The device is fastened to a plate (c).

Figure 2:
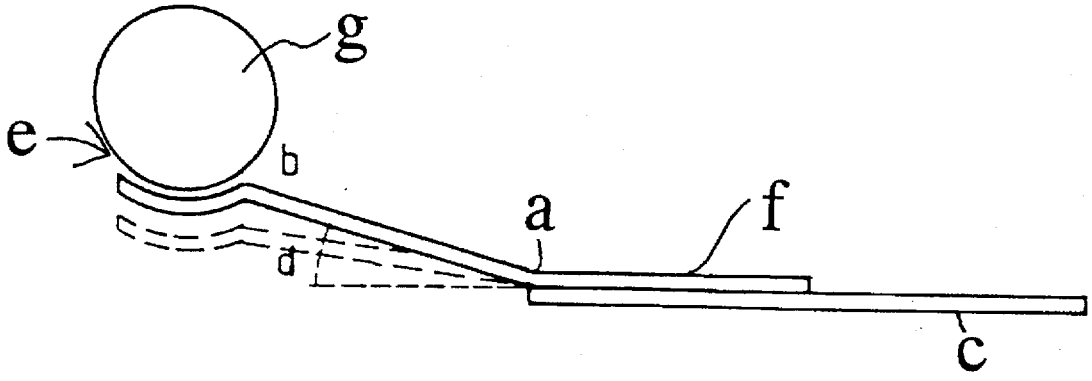
FIG. 2 shows the device seen from the side.

FIG. 2 shows that the inclined plane starts at (a) and ends at (b) where it turns into the slightly cup-shaped ball-lie (e). The angle at (d) and the length of the inclined plane decides the height of the ball-lie over the mat. The angle can be changed by transforming the material. The elasticity of the inclined plane is shown with lines of short dashes indicating a deflective position. A ball (g) is shown in the ball-lie (e), also herein called a ball-cup or a slightly cup-shaped circular portion.

At the lower end of the ramp, i.e. at the level of (a), the rod extends parallel to the ground for attachment of the device to ground plate (c). The first leg of the inclined ramp is continuous with a first base portion (f) distal the slightly cup-shaped circular portion (e) and the second leg of the inclined ramp is continuous with a second base portion (f), also distal the slightly cup-shaped circular portion (e). As seen in FIG. 2, the first base portion (f) and the second base portion (f) are bent out of the first plane, are attached to the ground plate (c), and are generally parallel.

The invention contemplates the device, and also the device as attached to the base plate (c).

I claim:

1. A device for teeing up a golf ball, comprising a unitary elongate rod formed into a shape, the shape further comprising:

a truncated V-shaped portion having a wider base end and a narrower upper end, the truncated V-shaped portion further comprising an upwardly inclined ramp; and ball-cup means for holding a golf ball in the form of a circular portion disposed at the upper end of the truncated V-shape;

the rod including a first leg of the upwardly inclined ramp continuous with a first end of the circular portion and a second leg of the inclined ramp continuous with a second end of the circular portion;

whereby golf may be practiced by teeing up while standing upright by poking the ball up the inclined ramp into the ball-cup when the wider base end of the truncated V-shaped portion is held to the ground.

2. The device according to claim 1, wherein the rod is formed of springy material, such that the inclined ramp is elastic.

3. The device according to claim 2, wherein the springy material includes iron.

4. The device according to claim 2, wherein the springy material includes plastic.

5. The device according to claim 1, wherein the circular portion is generally circular in a first plane defined by the inclined ramp and is slightly cup-shaped in a second plane perpendicular to the first plane and parallel to a length of the inclined ramp.

6. The device according to claim 1, wherein the first leg of the inclined ramp is continuous with a first base portion distal the circular portion and the second leg of the inclined ramp is continuous with a second base portion distal the circular portion, and wherein the first base portion and the second base portion are bent out of the first plane.

7. The device according to claim 6, comprising a ground plate attached to the first base portion and the second base portion.

8. The device according to claim 7, wherein the rod includes springy material, such that the inclined ramp is elastic.

9. The device according to claim 8, wherein the springy material includes iron.

10. The device according to claim 8, wherein the springy material includes plastic.

11. The device according to claim 6, wherein the the first base portion and the second base portion are generally parallel.

* * * * *